US007871304B2

(12) United States Patent
Lovato

(10) Patent No.: US 7,871,304 B2
(45) Date of Patent: Jan. 18, 2011

(54) DEVICE FOR ENHANCING SPORTING EVENT ON TELEVISION

(76) Inventor: Anthony R. Lovato, 2600 Metzgar SW., Albuquerque, NM (US) 87105

( * ) Notice: Subject to any disclaimer, the term of this patent is extended or adjusted under 35 U.S.C. 154(b) by 405 days.

(21) Appl. No.: 12/170,987

(22) Filed: Jul. 10, 2008

(65) Prior Publication Data

US 2010/0009595 A1 Jan. 14, 2010

(51) Int. Cl.
*A63H 3/00* (2006.01)

(52) U.S. Cl. ..... 446/268; 446/236; 446/308; 446/489; 446/484; 446/376

(58) Field of Classification Search ..... 446/72, 446/73, 236, 265, 268, 330, 331, 353, 354, 446/358, 390, 433, 484, 489, 308, 309, 376; 40/411, 419, 414, 418, 420, 415; 221/277, 221/258; 273/119 R
See application file for complete search history.

(56) References Cited

U.S. PATENT DOCUMENTS 1,172,570 A * 2/1916 Toelle ..... 124/7
1,512,985 A * 10/1924 Houldsworth ..... 273/119 R
1,782,163 A * 11/1930 Cook ..... 273/317.1
2,296,541 A * 9/1942 Schuyler ..... 40/419
3,425,153 A * 2/1969 Crosman et al. ..... 446/308
3,664,670 A * 5/1972 Glass et al. ..... 273/405
3,928,932 A * 12/1975 Maurer ..... 446/303
4,262,445 A * 4/1981 Orenstein ..... 446/308
4,995,371 A * 2/1991 Kuizinas ..... 124/7
5,619,977 A * 4/1997 Gatin ..... 124/7
5,975,527 A * 11/1999 Winchester ..... 273/129 V
6,171,169 B1 * 1/2001 Saunders ..... 446/308

* cited by examiner

*Primary Examiner*—Gene Kim
*Assistant Examiner*—Matthew B Stanczak
(74) *Attorney, Agent, or Firm*—Luis M. Ortiz; Kermit D. Lopez; Ortiz & Lopez, PLLC

(57) ABSTRACT

A gaming device for enhancing sporting event on television including an assembled unit loaded with a number of pins/flags and a remote control through which the unit receives radio/infrared signals in order to actuate the device. A right arm of the figurine is connected to a stepper motor and can be placed on top of the assembled unit. When the user depresses the button on the remote control the stepper motor makes one revolution and the hand portion of the arm makes contact with the pin/flag and ejects the pin/flag out of the assembled unit in order to signal rule infractions associated with a game. The device simply gives users the satisfaction of calling their own penalties, and or counts the number of actual penalties in the game.

19 Claims, 4 Drawing Sheets

DEVICE FOR ENHANCING SPORTING EVENT ON TELEVISION

TECHNICAL FIELD

The present invention generally relates to a gaming device, and in particular, to a device for enhancing viewing enjoyment of sports audiences. More specifically, the present invention relates to a device which enables fans to track the occurrence of rules infractions associated with a game and remotely engage in the unofficial officiating of a game viewed remotely on television.

BACKGROUND OF THE INVENTION

Gaming devices are well known in the art and a large variety of gaming devices have been developed. In many sporting events it is the job of a referee or an umpire to assess penalties to a player or a team for infractions of rules during play. For example in the game of football, after a play has commenced, there often occur rule infractions by one or more players of either of the two competing teams. It is customary for one or more referees to drop a handkerchief, termed a flag, on the ground upon the referee's observation of a rules infraction. Quite often, a television viewer can see what they perceive as an infraction but the actual game referee did not observe the same thing.

A Majority of the fans viewing the sporting event in television would like to become more involved in the sporting event. Hence there is a need for a gaming device that can be utilized by a viewer for keeping track of infractions observed during the sporting event. In addition, it would be desirable to have a device that has the capability to allow the viewer to throw their own flag for their own satisfaction, or to simply keep track of the actual penalties that the game referees have deemed official. The present invention accomplishes these objectives.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved gaming device for entertainment while watching a sporting event on television.

It is another aspect of the present invention to provide for an improved gaming device that enables users to call their own penalties thereby counting the number of actual penalties in the game.

The aforementioned aspects and other objectives and advantages can now be achieved as described herein. A gaming device for enhancing a sporting event on television comprises an assembled unit loaded with a number of pins/flags and a remote control through which the unit receives radio/infrared signals in order to actuate the device. A right arm of the figurine is connected to a stepper motor and can be placed on top of the assembled unit. When the user depresses the button on the remote control the stepper motor makes one revolution and the hand portion of the arm makes contact with the pin/flag and ejects the pin/flag out of the assembled unit in order to signal rule infractions associated with a game. The device simply gives users the satisfaction of calling their own penalties, and or counts the number of actual penalties in the game.

The right arm of the figurine possesses a 360-degree range of motion. A wireless controller receives the signals from the remote control to activate the stepper motor for a long enough time as to cause one revolution of the stepper motor. An antenna can be provided to receive a radio frequency signal from a remote control and/or an infrared receiver eye can receive infrared signals projected from a remote control. A resetting remote counter receives the signal from the remote control to keep count of activation of the assembled unit that corresponds to the rule infractions. A battery can energize the device by activating an on/off switch. Such a device exhibits utility in any sport wherein the occurrence of rules infraction of the game signaled by throwing a flag/pin onto the field of play or anything the user finds worthy of attention, on the television screen.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
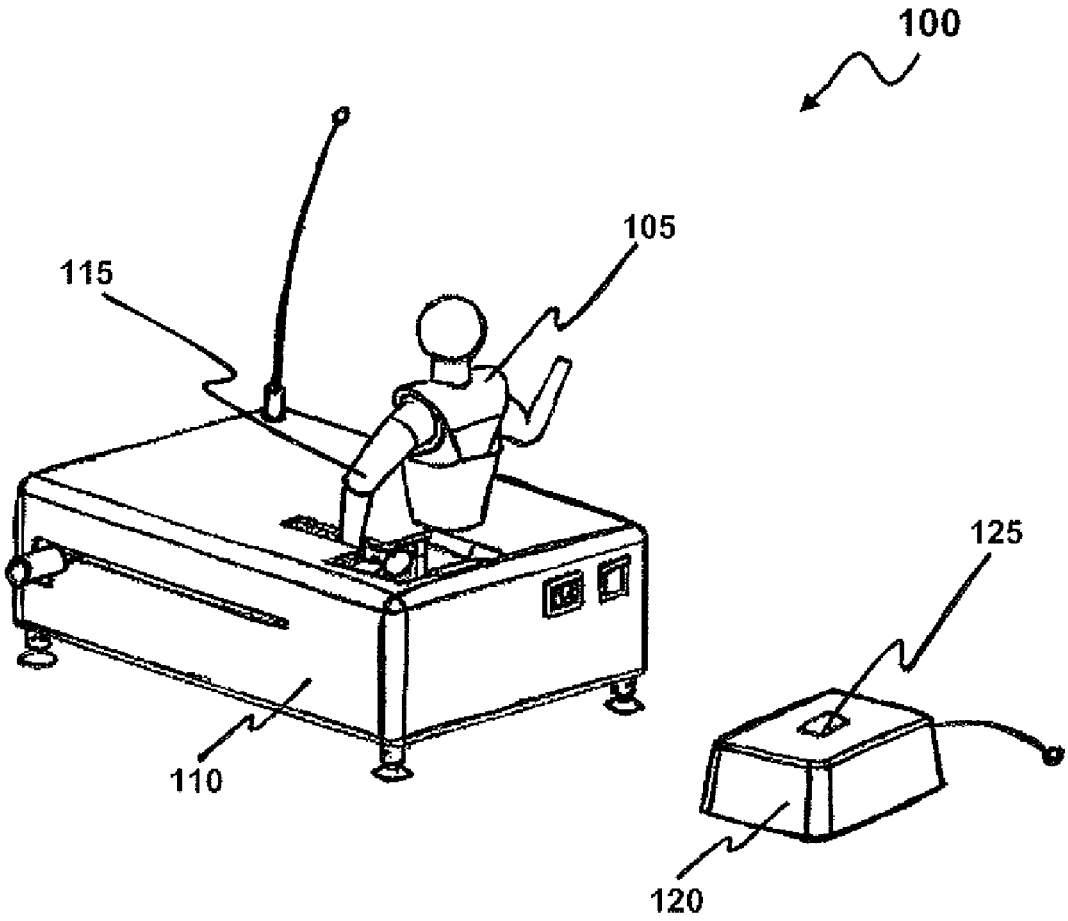
FIG. 1 illustrates a perspective view of a gaming device, in accordance with a preferred embodiment.

FIG. 1 illustrates a perspective view of a gaming device 100, in accordance with a preferred embodiment. Note that in FIGS. 1-3 identical parts or elements are generally indicated by identical reference numerals. The gaming device 100 generally includes an assembled unit 110 and a remote control 120. A button/switch 125 on the remote control 120 can be pushed when a user observes a rule infraction associated with a game. The simple push of the button 125 on the remote control 120 actuates the device 100 and a small replica of a referees' yellow handkerchief or a flag will be ejected by the arm 115 of a figurine 105 from the assembled unit 110 in proximity to where the user has placed the assembled unit 110. The figurine 105 represents the top half of a mock sports official.

Figure 2:
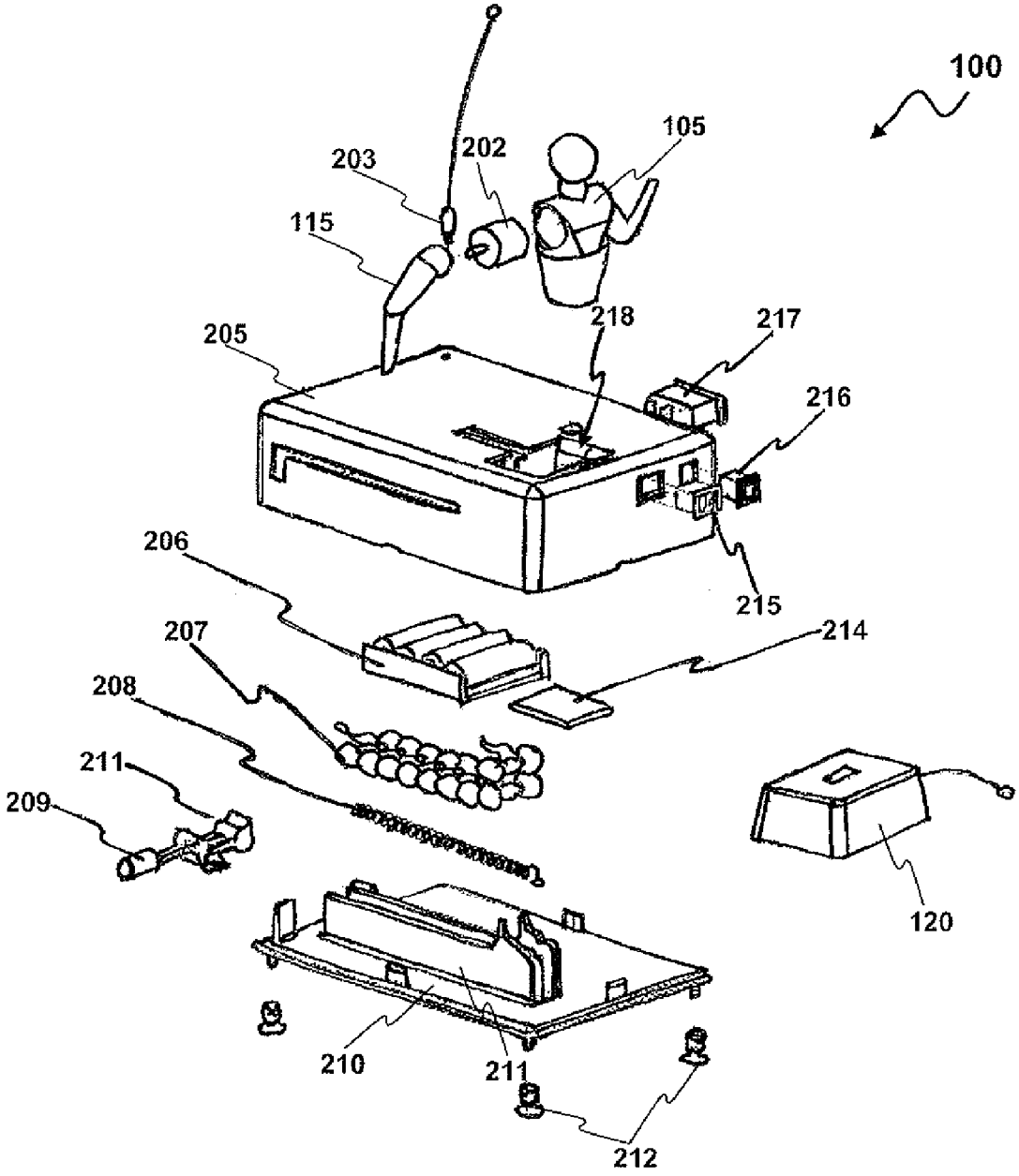
FIG. 2 illustrates an exploded view of the gaming device, in accordance with a preferred embodiment.

FIG. 2 illustrates an exploded view of a gaming device 100, in accordance with a preferred embodiment. The device 100 generally includes a base 210 and a housing 205. A raised set of rails 211 formed on the base 210 within the housing 205 are placed directly opposite of each other. A gap between the two rails 211 allows room for the placement of a number of pins and/or flags 207. The pins and/or flags 207 can be loaded into the unit 110 individually. However, the flags 207 loaded into the unit 110 can be a small replica of a referees' yellow handkerchief or a flag. A push pad 209 can be manually raised into position behind the pins 207, thus enabling a pull spring 208 connected to a pull lever 209 to cause tension with an integrated, or connected, push pad 211 on the pins 207 in the direction of an ejection port 218 for the top and front of the housing 205. The unit 110 can be energized by a battery 206 by activating an on/off switch 217 by a user. A stepper motor 202 is located in the chest of the figurine 201 and is connected to a right arm 115 of the figurine 105. The arm 115 possesses a 360-degree range of motion. When the user depresses the button on the remote control 120, a signal (either radio or infrared) can be received by a wireless controller 214 to activate the stepper motor 202 for a long enough time as to cause one revolution of the motor 202. Thus, one full revolution of the stepper motor 202 will produce a full 360-degree rotation of the figurines arm 115.

The arm 115 is centered on top of the ejection port 218 and on top of the housing 205. The hand portion of the arm 115, upon rotation, makes contact with the existing tension loaded pin 207 (e.g., flat) seated in the ejection port 218. Such a contact is enough to eject the pin 207 out of the unit 110, while the next pin 207 is moved forward into position from the tension of the pull spring 208, and the unit 110 is ready for use again. The signal from the remote control 120 can also be sent to a resetting numeric counter 215, which counts the number of times the unit 110 is activated that corresponds to rule infractions to a game. The device 100 can either be operated by a radio frequency controller or an infrared controller and detector applications.

When radio frequency communication is used, an antenna 203 receives the radio frequency signal from the remote control 120. When infrared communication is used, an infrared receiver eye 216 receives infrared signal from the remote control 120. The assembled unit 110 can be located on supporting legs 212. Note that the embodiments discussed herein generally relate to a gaming device in a basic box configuration with a figurine 105 on top. It can be appreciated, however, that such embodiments can be implemented in the context of other designs and enclosure shapes, and are not limited to the box configuration. The discussion of box configuration, as utilized herein, is presented for general illustrative purposes only. For example, the unit 110 may resemble an actual football or the entire figurine torso of a referee. The exact form or appearance of the device 100 does not limit or define the practice of the invention.

Figure 3:
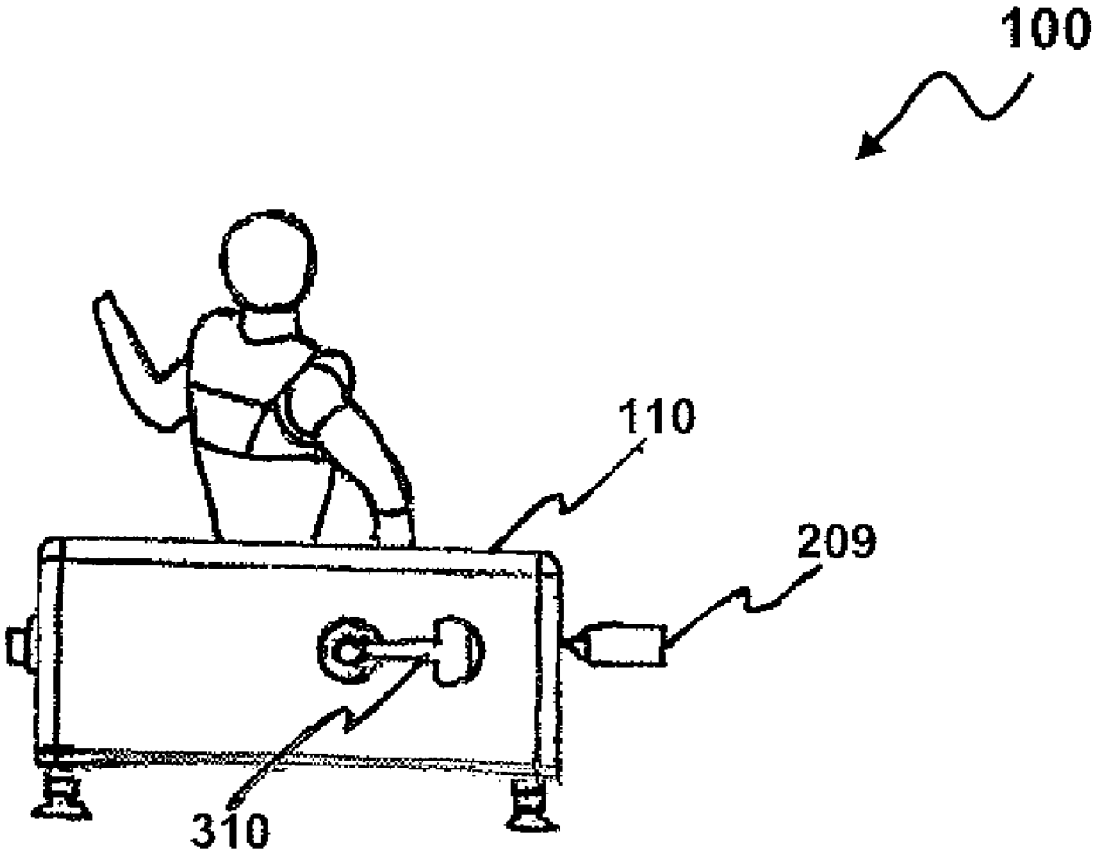
FIG. 3 illustrates a general view of the gaming device with a push pad and a portal, in accordance with a preferred embodiment.

FIG. 3 illustrates a general view of a gaming device 100 with the pull lever 209 and a portal 310, in accordance with a preferred embodiment. The pins and/or flags 207 can be placed through a portal 310 in the rear of the unit 110 as shown in FIG. 3. Once these pins 207 are loaded into the unit 110 individually, the push pad 211 can be manually raised into position behind the pins 207 by movement of the pull lever 209, thus enabling the pull spring 208 which is connected to the push pad 209, to cause tension on the pins 207, in the direction of the ejection port 218 which is located on the top and to the front of the box 205. The resetting numeric counter 215 counts the number of times the device 100 is activated thereby the number of penalties in the game. The gaming device 100 can be utilized for entertainment while watching a sporting event on television. The user can press the switch on the remote control 120 when a rule infraction is seen to eject the pins and/or flags 207 out of the unit 110 and into plain sight, landing in proximity to where the user has placed the unit 110. Thus, resembling a penalty flag in the game of football as thrown by a referee.

The device 100 simply gives users the satisfaction that they can call their own penalties, and or count the number of actual penalties in the game. The device 100 can be placed on top of a television or in any place based on user preference. The device 100 can be loaded with miniature flags so that a flag can be ejected from the unit when the device gets activated. The device also exhibits utility in any sport wherein the occurrence of rules infraction of the game signaled by throwing a flag or other object onto the field of play or anything the user finds worthy of attention on the television screen.

Figure 4:
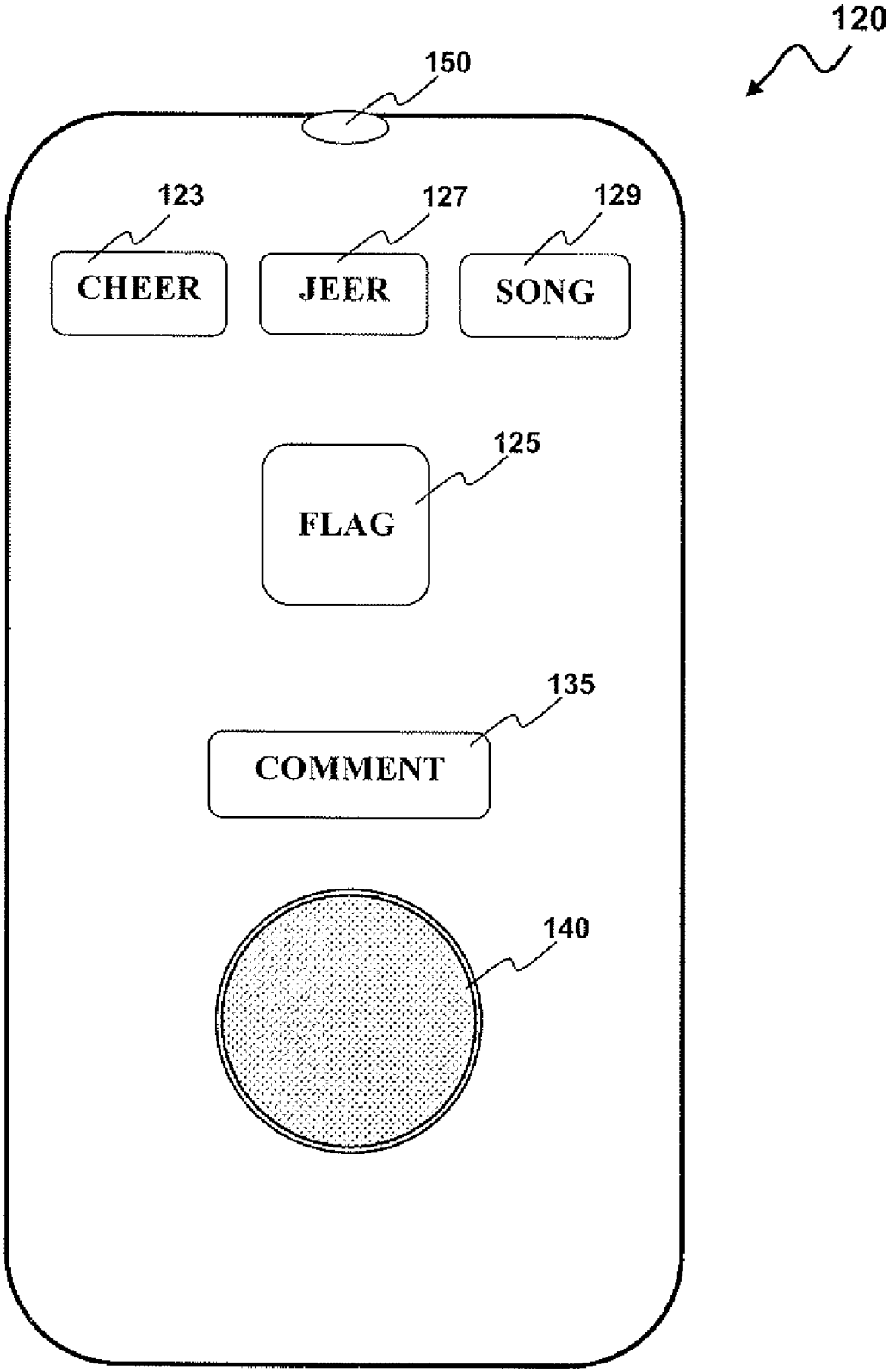
FIG. 4 illustrates a general view for an alternate embodiment of the remote control device, in accordance with a preferred embodiment.

Referring to FIG. 4, a plan view of the face of a remote control 120 in accordance with features of the present invention is illustrated. The remote control includes a "flag" button, which is used to communicate with the unit 110 to cause ejection of flags/pins from the unit 110. The remote control 120 can also include a "Cheer" button 123, a "Jeer" button 127, a "Song" button 129 and a "Comment" button 135. The comment and song button utilize a speaker to 140 and underlying amplification circuitry (not shown, but generally known) to enable song or comments typical to sporting events and in the field of officiating. An infrared transmitter 150 can be included if the remote control is infrared-based communications. Otherwise, an internal antennae can provide communication from the remote control 120 to the base unit 110.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sports entertainment device, comprising:

a base including a raised set of rails positioned directly opposite of each other wherein and forming a gap adapted to enable room for placement and movement of a plurality of flags received into a housing from a portal formed therein at a rear portion of said housing;

a push pad manually raised into position by a pull lever behind said plurality of flags, said push pad enabling a pull spring connected to said push pad to cause tension on said plurality of flags in the direction along said set of rails to a position beneath an ejection port which is formed at the top and near a front of said housing; and a stepper motor located in a chest of a figurine and connected to a right arm of said figurine wherein said right arm upon rotation makes contact with existing tension loaded in said flag seated in said ejection port to eject said flag out of said unit in order to signal rule infractions associated with a game.

2. The sports entertainment device of claim 1 further comprising: a wireless controller that receives a signal from a remote control to activate said stepper motor for a long enough time as to cause one revolution of said stepper motor.

3. The sports entertainment device of claim 1 wherein said plurality of flags comprises a plurality of pins.

4. The sports entertainment device of claim 1 wherein said signal comprises a radio signal and/or an infrared signal.

5. The sports entertainment device of claim 1 further comprising: an antenna for receiving said radio frequency signal from said remote control.

6. The sports entertainment device of claim 1 further comprising: an infrared receiver eye for receiving said infrared signal from said remote control.

7. The sports entertainment device of claim 1 further comprising: a resetting numeric counter that receives said signal from said remote control to keep count of activation of said assembled unit that corresponds to said rule infractions.

8. The sports entertainment device of claim 1 wherein said assembled unit is energized by a battery by activating an on/off switch.

9. The sports entertainment system of claim 1 wherein said right arm of said figurine possess a 360-degree range of motion.

10. A sports entertainment device, comprising:

a base unit including a raised set of rails positioned directly opposite of each other wherein and forming a gap adapted to enable room for placement and movement of a plurality of flags received into a housing from a portal formed therein at a rear portion of said housing;

a push pad manually raised into position by a pull lever behind said plurality of flags, said push pad enabling a pull spring connected to said push pad to cause tension on said plurality of flags in the direction along said set of rails to a position beneath an ejection port which is formed at the top and near a front of said housing;

a stepper motor located in a chest of a figurine and connected to a right arm of said figurine wherein said right arm upon rotation makes contact with existing tension loaded in said flag seated in said ejection port to eject said flag out of said base unit in order to signal rule infractions associated with a game; and a remote control including a button and transmitter enabled by the button, wherein said remote control communicates with said base unit and is adapted to remotely cause said stepper motor to rotate said right arm of said figurine to cause a flag to be ejected from the ejection port.

11. The device of claim 10 wherein said remote control is adapted to provide a signal to said base unit, said signal including at least one of a radio signal and an infrared signal.

12. A method using a gaming device for enhancing sporting event watched on a television monitor, said method including the steps of:

providing an assembled unit loaded with a number of pins/flags and a remote control through which the unit is adapted to receive radio/infrared signals in order to actuate the device including a rotating right arm of the figurine connected to a stepper motor, said figurine placed on top of the assembled unit and said arm having a hand portion;

providing a remote control in communication with the assembled unit, wherein said remote control is adapted with a button wherein said stepper motor makes one revolution and the hand portion of the arm makes contact with the pin/flag and ejects the pin/flag out of the assembled unit when the user depresses the button on the remote control in order to signal rule infractions associated with a game; and enabling a fan to electively cause by remote control said stepper motor to make one revolution and the hand portion of the arm to makes contact with a pin/flag loaded in said assembled unit and ejects the pin/flag out of the assembled unit when the user depresses a button on the remote control, thereby signaling a rule infraction while remotely viewing a sporting event on television.

13. The method of claim 12 wherein said signal comprises at least one of a radio frequency signal and an infrared signal transmitted from the remote control for receipt by the assembled unit.

14. The method of claim 12 wherein said assembled unit is adapted with a wireless controller that receives a signal from a remote control to activate said stepper motor for a long enough time as to cause one revolution of said stepper motor.

15. The method of claim 12 wherein said plurality of flags comprises a plurality of pins.

16. The method of claim 12 wherein said remote control and said assembled unit are each adapted with an antenna for at least transmitting and receiving radio frequency signals.

17. The method of claim 12 wherein said remote control and said assembled unit are each adapted with an infrared transceiver for at least one of transmitting and receiving infrared signals.

18. The method of claim 12 said assembled unit further adapted to reset a numeric counter included in said assembled unit that is adapted to receive a signal from the remote control and keep count of activations by said assembled unit that corresponds to said rule infractions.

19. The device of claim 12 wherein said assembled unit is energized by a battery by activating an on/off switch.

* * * * *